United States Patent [19]

Wu

[11] Patent Number: 4,990,709

[45] Date of Patent: Feb. 5, 1991

[54] C2-C5 OLEFIN OLIGOMERIZATION BY REDUCED CHROMIUM CATALYSIS

[75] Inventor: Margaret M. Wu, Belle Mead, N.J.

[73] Assignee: Mobil Oil Corporation, Fairfax, Va.

[21] Appl. No.: 345,061

[22] Filed: Apr. 28, 1989

[51] Int. Cl.[5] ..... C10L 1/16

[52] U.S. Cl. ..... 585/10; 585/17; 585/411; 585/452

[58] Field of Search ..... 585/11, 19, 411, 452, 585/10, 17

[56] References Cited

U.S. PATENT DOCUMENTS

| | | | |
|---|---|---|---|
| 3,232,913 | 2/1966 | Van Weynbergh et al. . | |
| 4,504,592 | 3/1985 | van de Leemput et al. | 502/104 |
| 4,681,866 | 7/1987 | McDaniel et al. | 502/154 |
| 4,827,064 | 5/1989 | Wu | 585/10 |
| 4,827,073 | 5/1989 | Wu | 585/530 |

FOREIGN PATENT DOCUMENTS

| | | |
|---|---|---|
| 3427319 | 1/1988 | Fed. Rep. of Germany . |
| 63-57615 | 3/1988 | Japan . |

*Primary Examiner*—Patrick P. Garvin
*Assistant Examiner*—E. D. Irzinski
*Attorney, Agent, or Firm*—Alexander J. McKillop; Charles J. Speciale; Malcolm D. Keen

[57] ABSTRACT

A process is disclosed for the oligomerization of $C_2$–$C_5$ alpha olefin mixtures or $C_3$–$C_5$ alpha-olefins alone to produce novel lubricant range products having high viscosity index and regio-regularity not greater than 40%. Lower hydrocarbon fractions useful as gasoline and distillate fuels are also produced. The process comprises contacting said mixtures or $C_3$–$C_5$ alpha-olefins with a reduced valence state chromium oxide catalyst on a silica support in an oligomerization zone under oligomerization conditions comprising a temperature from 90° C. to 250° C. The process can be carried out in dilute form using an inert solvent such as octane. The lubricant products can be produced in wide range of viscosities including the direct production of low viscosity lubricants having high viscosity index.

30 Claims, No Drawings

C2-C5 OLEFIN OLIGOMERIZATION BY REDUCED CHROMIUM CATALYSIS

This invention relates to a process for the oligomerization of $C_2$–$C_5$ alpha-olefins. In particular, the invention relates to a process for the oligomerization of $C_3$–$C_5$ alpha-olefins or mixtures of $C_2$–$C_5$ alpha-olefins using reduced chromium oxide on a solid support as catalyst. The products of the process are useful, inter alia, as lubricants of superior quality which exhibit high viscosity index and as chemical intermediates.

BACKGROUND OF THE INVENTION

Efforts to improve upon the performance of natural mineral oil based lubricants by the synthesis of oligomeric hydrocarbon fluids have been the subject of important research and development in the petroleum industry for at least fifty years and have led to the relatively recent market introduction of a number of superior polyalpha-olefin (PAO) synthetic lubricants, primarily based on the oligomerization of alpha-olefins or 1-alkenes. In terms of lubricant property improvement, the thrust of the industrial research effort on synthetic lubricants has been toward fluids exhibiting useful viscosities over a wide range of temperature, i.e., improved viscosity index (VI), while also showing lubricity, thermal and oxidative stability and pour point equal to or better than mineral oil. These new synthetic lubricants lower friction and hence increase mechanical efficiency across the full spectrum of mechanical loads from worm gears to traction drives and do so over a wider range of operating conditions than mineral oil lubricants.

Catalysts that have been found useful in the prior art for the oligomerization of alpha-olefins to PAO include Lewis acids and Ziegler catalysts. The products have been found to differ significantly in lubricant properties according to the catalyst used and the process economics are also affected by ease of separation, corrosivity and other catalyst dependent process characteristics. Brennan, Ind. Eng. Chem. Prod. Res. Dev. 1980, 19, 2–6, cites 1-decene trimer as an example of a structure compatible with structures associated with superior low temperature fluidity wherein the concentration of atoms is very close to the center of a chain of carbon atoms. Also described therein is the apparent dependency of properties of the oligomer on the oligomerization process, i.e., cationic polymerization or Ziegler-type catalyst, known and practiced in the art.

A process using coordination catalysts to prepare high polymers from 1-alkenes, especially chromium catalyst on a silica support, is described by Weiss et al. in Jour. Catalysis 88, 424–430 (1984) and in Offen. DE 3,427,319. The process and products therefrom are discussed in more detail hereinafter in comparison with the process and products of the instant invention.

Recently, novel lubricant compositions (referred to herein as HVI-PAO and the HVI-PAO process) comprising polyalpha-olefins and methods for their preparation employing as catalyst reduced chromium on a silica support have been disclosed in U.S. patent application Ser. Nos. 210,434 and 210,435 filed June 23, 1988, now U.S. Pat. Nos. 4,827,073 and 4,827,064 incorporated herein by reference in their entirety. The process comprises contacting $C_6$–$C_{20}$ 1-alkene feedstock with reduced valence state chromium oxide catalyst on porous silica support under oligomerizing conditions in an oligomerization zone whereby high viscosity, high VI liquid hydrocarbon lubricant is produced having branch ratios less than 0.19 and pour point below −15° C. The process is distinctive in that little isomerization of the olefinic bond occurs compared to known oligomerization methods to produce polyalpha-olefins using Lewis acid catalyst. Lubricants produced by the process cover the full range of lubricant viscosities and exhibit a remarkably high viscosity index (VI) and low pour point even at high viscosity. The as-synthesized HVI-PAO oligomer has a preponderance of terminal olefinic unsaturation.

Considering the abundance of $C_2$ to $C_5$ alpha-olefins in the petroleum refinery, and their low cost, it has long been been recognized that they could be a preferred source of low cost lubricant if they could be oligomerized to provide high viscosity index lubricant in good yield with a manageable, regenerable, non-corrosive catalyst. Accordingly, the objectives of the present invention include:

a novel process for the oligomerization of $C_3$ to $C_5$ alpha-olefins or mixtures of $C_2$ to $C_5$ alpha-olefins to produce a lubricant of superior quality;

a novel process for the oligomerization of $C_3$ to $C_5$ alpha-olefins or mixtures of $C_2$ to $C_5$ alpha-olefins that provides hydrocarbon lubricants and chemical intermediates;

and the foregoing novel process using a low cost catalyst that is essentially non-corrosive, readily recoverable and regenerable.

SUMMARY OF THE INVENTION

A unique liquid lubricant composition, and process for the production thereof, has been discovered comprising the product of the oligomerization of $C_3$–$C_5$ alpha-olefin feedstock, or mixtures $C_2$–$C_5$ alpha-olefin feedstock, under oligomerization conditions in contact with a reduced valence state Group VIB metal catalyst on porous support. The lubricant has a high viscosity index compared to the oligomerization products using acidic or Ziegler catalysis. The lubricant product from the oligomerization of $C_3$–$C_5$ alpha-olefins or a mixture of $C_2$ to $C_5$ alpha-olefin according to this invention has a high VI.

The novel process of the present invention comprises a process for the preparation of liquid hydrocarbons comprising the steps of: contacting $C_3$–$C_5$ alpha-olefins or a mixture of $C_2$ to $C_5$ alpha-olefins with chromium catalyst on a solid support, which catalyst has been treated by oxidation at a temperature of 200° C. to 900° C. in the presence of an oxidizing gas and then by treatment with a reducing agent at a temperature and for a time sufficient to reduce said catalyst. The contacting takes place under conditions sufficient to produce liquid olefin oligomers having a viscosity measured at 100° C. of 10,000 cS useful as lubricant basestock or used as VI improvers. The oligomers are hydrogenated to produce a saturated hydrocarbon.

Propylene, 1-butene or 1-pentene can, individually, be oligomerized in a similar manner and the olefin oligomers are separated by distillation to recover a gasoline boiling range overhead fraction, a distillate boiling range overhead fraction, and a lube boiling range bottoms fraction.

The novel process followed by a hydro-finishing step provides excellent yields of a saturated hydrocarbon lubricant fraction from the oligomerization of $C_3$–$C_5$ alpha-olefins or a mixture of $C_2$ to $C_5$ alpha-olefins. The oligomerization of ethene, propylene or 1-butene or 1-pentene to produce the lubricant fraction results in a product particularly distinguished by a high viscosity index representative of superior lubricant properties. The lighter oligomer or hydrocarbon fraction separated from the oligomerization mixture is useful as gasoline or distillate product.

The oligomer products containing unsaturated double bonds are suitable as chemical intermediates for further functionalization, e.g., reaction with maleic anhydride.

DETAIL DESCRIPTION OF THE INVENTION

In the following description, unless otherwise stated, all references to properties of oligomers or lubricants of the present invention refer as well to hydrogenated oligomers and lubricants wherein hydrogenation is carried out in keeping with the practice well known to those skilled in the art of lubricant production.

In the present invention it has been found that $C_2$–$C_5$ alpha-olefins can be oligomerized to provide unique products using the process for the oligomerization of alpha-olefins referenced herein before. The novel oligomers of the referenced invention, or high viscosity index polyalphaolefins (HVI-PAO) are unique in their structure compared with conventional polyalphaolefins (PAO) from 1-decene, for example. Polymerization with the novel reduced chromium catalyst described hereinafter leads to an oligomer substantially free of double bond isomerization. Conventional PAO, on the other hand, promoted by $BF_3$ or ALCl3 forms a carbonium ion which, in turn, promotes isomerization of the olefinic bond and the formation of multiple isomers. The HVI-PAO produced in the referenced invention has a structure with a $CH_3/CH_2$ ratio $<0.19$ compared to a ratio of $>0.20$ for PAO. Now it has been found that ethylene, propylene, 1-butene or 1-pentene, or mixtures thereof, can also be oligomerized with reduced chromium under conditions yielding valuable gasoline, distillate and superior lubricant range products in good yield.

The $C_2$–$C_5$ feedstocks used in the present invention are particularly inexpensive and common materials found in the petroleum refinery complex. Readily available sources include fluid catalytic cracker operation; in particular, the product of FCC unsaturated gas plant. The olefins are also available from the various steam cracking processes, e.g., light naphtha or LPG.

This new class of alpha-olefin oligomers referenced above are prepared by oligomerization reactions in which a major proportion of the double bonds of the alphaolefins are not isomerized. These reactions include alpha-olefin oligomerization by supported metal oxide catalysts, such as Cr compounds on silica or other supported IUPAC Periodic Table Group VIB compounds. The catalyst most preferred is a lower valence Group VIB metal oxide on an inert support. Preferred supports include silica, alumina, titania, silica alumina, magnesia and the like. The support material binds the metal oxide catalyst. Those porous substrates having a pore opening of at least 40 angstroms are preferred.

The support material usually has high surface area and large pore volumes with average pore size of 40 to about 350 angstroms. The high surface area are beneficial for supporting large amount of highly dispersive, active chromium metal centers and to give maximum efficiency of metal usage, resulting in very high activity catalyst. The support should have large average pore openings of at least 40 angstroms, with an average pore opening of $>60$ to 300 angstroms preferred. This large pore opening will not impose any diffusional restriction of the reactant and product to and away from the active catalytic metal centers, thus further optimizing the catalyst productivity. Also, for this catalyst to be used in fixed bed or slurry reactor and to be recycled and regenerated many times, a porous support with good physical strength is preferred to prevent catalyst particle attrition or disintegration during handling or reaction.

The supported metal oxide catalysts are preferably prepared by impregnating metal salts in water or organic solvents onto the support. Any suitable organic solvent known to the art may be used, for example, ethanol, methanol, or acetic acid. The solid catalyst precursor is then dried and calcined at 200° to 900° C. by air or other oxygen-containing gas. Thereafter the catalyst is reduced by any of several various and well known reducing agents such as, for example, CO, $H_2$, $NH_3$, $H_2S$, $CS_2$, $CH_3SCH_3$, $CH_3SSCH_3$, metal alkyl containing compounds such as $R_3Al$, $R_3B$, $R_2Mg$, RLi, $R_2Zn$, where R is alkyl, alkoxy, aryl and the like. Preferred are CO or $H_2$ or metal alkyl containing compounds. Alternatively, the Group VIB metal may be applied to the substrate in reduced form, such as CrII compounds. The resultant catalyst is very active for oligomerizing olefins at a temperature range from below room temperature to about 250° C. at a pressure of 0.1 atmosphere to 5000 psi. Contact time of both the olefin and the catalyst can vary from one second to 24 hours. The catalyst can be used in a batch type reactor, a continuous stirred tank reactor or in a fixed bed, continuous-flow reactor.

In general the support material may be added to a solution of the metal compounds, e.g., acetates or nitrates, etc., and the mixture is then mixed and dried at room temperature. The dry solid gel is purged at successively higher temperatures to about 600° for a period of about 16 to 20 hours. Thereafter the catalyst is cooled down under an inert atmosphere to a temperature of about 250° to 450° C. and a stream of pure reducing agent, such as CO, is contacted therewith. When enough CO has passed through to reduce the catalyst there is a distinct color change from bright orange to pale blue. Typically, the catalyst is treated with an amount of CO equivalent to a two-fold stoichiometric excess to reduce the catalyst to a lower valence CrII state. Finally the catalyst is cooled down to room temperature and is ready for use.

As referenced hereinbefore, supported Cr metal oxide in different oxidation states is known to polymerize alpha olefins from $C_3$ to $C_{20}$ (De 3427319 to H. L. Krauss and Journal of Catalysis 88, 424–430, 1984) using a catalyst prepared by $CrO_3$ on silica. The referenced disclosures teach that polymerization takes place at low temperature, usually less than 100° C., to give adhesive polymers and that at high temperature, the catalyst promotes isomerization, cracking and hydrogen transfer reactions. The present invention produces low molecular weight oligomeric products under reaction conditions and using catalysts which minimize side reactions such as 1-olefin isomerization, cracking, hydrogen transfer and aromatization. To produce the novel low molecular weight products suitable for use as lube basestock or as blending stock with other lube stock, the reaction of the present invention is carried out at a temperature higher (90°–250° C.) than the temperature suitable to produce high molecular weight polyalpha-olefins. The catalysts used in the present invention do not cause a significant amount of side reactions even at high temperature when oligomeric, low molecular weight fluids are produced.

The catalysts for this invention thus minimize all side reactions but oligomerize olefins to give low molecular weight polymers with high efficiency. It is well known in the prior art that chromium oxides, especially chromia with average +3 oxidation states, either pure or supported, catalyze double bond isomerization, dehydrogenation cracking, etc. Although the exact nature of the supported Cr oxide is difficult to determine, it is thought that the catalyst of the present invention is rich in Cr(II) supported on silica, which is more active to catalyze alpha-olefin oligomerization at high reaction temperature without causing significant amounts of isomerization, cracking or hydrogenation reactions, etc. However, catalysts as prepared in the cited references can be richer in Cr (III). They catalyze alpha-olefin polymerization at low reaction temperature to produce high molecular weight polymers. However, as the references teach, undesirable isomerization, cracking and hydrogenation reaction takes place at higher temperatures. In contrast, high temperatures are needed in this invention to produce lubricant products. The prior art also teaches that supported Cr catalysts rich in Cr(III) or higher oxidation states catalyze 1-butene isomerization with $10^3$ higher activity than polymerization of 1-butene. The quality of the catalyst, method of preparation, treatments and reaction conditions are critical to the catalyst performance and composition of the product produced and distinguish the present invention over the prior art.

In the instant invention very low catalyst concentrations based on feed, from 10 wt % to 0.01 wt %, are used to produce oligomers; whereas, in the cited references catalyst ratios based on feed of 1:1 are used to prepare high polymer. Resorting to lower catalyst concentrations in the present invention to produce lower molecular weight material runs counter to conventional polymerization theory, compared to the results in the cited references.

The oligomers of 1-olefins prepared in this invention usually have much lower molecular weights than the polymers produced in cited reference which are semi-solids, with very high molecular weights. They are not suitable as lubricant basestocks. These high polymers usually have no detectable amount of dimer or trimmer ($C_{10}$–$C_{30}$) components from synthesis. These high polymers also have very low unsaturations. However, products in this invention are free-flowing liquids at room temperature, suitable for lube basestock.

In the following examples the process of the present invention are illustrated. In the invention, propylene and mixtures of ethylene and propylene are oligomerized using reduced chromium oxide on a silica support as catalyst. The catalyst is prepared following the procedure described in the preceding examples.

Ethylene and $C_3$–$C_5$ alpha-olefins are abundant and cheap raw materials. According to the present invention, $C_3$–$C_5$ alpha-olefins or mixed $C_2$–$C_5$ alpha-olefins, either in dilute form or in pure form can be upgraded into a wide range of hydrocarbon products. The high boiling components can be used as high quality lubricants with high viscosity index. The low boiling components can be used as gasoline, distillate or starting material for synthetic detergents, additives to fuel, lubricants or plastics. The catalyst for the conversion is a supported metal oxide such as group VIB and group VIIIB oxides on silica catalyst. The mixtures of propylene, 1-butene or 1-pentene and ethylene can be used in a molar ratio from 100 to 1 to 1 to 1, with a preferred molar ratio of about 20 to 1.

The use of activated supported metal oxide catalyst to produce a wide range of hydrocarbons from $C_2$–$C_5$ alpha-olefin mixtures is unique. The lube fraction of the hydrocarbons have high viscosity indices.0412 The catalyst employed in the present invention is a solid catalyst and is significantly easier to handle than conventional Ziegler catalyst and other solution catalyst. The by-products with low boiling points have carbon numbers from $C_5$ to $C_{30}$. These by-products have unsaturated olefin double bonds and can be used as starting materials for synthesis of detergents, fuel or lube additives. The catalyst used are non-corrosive and are regenerable.

In the oligomerization of propylene, 1-butene or 1-pentene, the alpha-olefin can be used either in pure form or in diluted form for upgrading into gasoline distillate and lube products over solid coordination catalyst. The fuel range products are high quality fuel with low sulfur and aromatic contents. The lube products, after hydrogenation to remove unsaturation have higher viscosity indices than such alpha-olefins oligomerized by conventional acid catalysts such as aluminum chloride or boron tri-fluoride.

In the present invention, lube compositions from the oligomerization of $C_2$–$C_5$ alpha-olefin mixtures or $C_3$–$C_5$ alpha-olefins can be produced with viscosities between 3 cS and 5000 cS measured at 100° C.

It has been discovered that the products of the instant invention exhibit a very unique structure that confers upon the products the properties of novel compositions. In conventional Ziegler oligomerization of alpha olefins it is well known in the art that the oligomers produced contain a high degree of structural regularity, or regio-regularity, as exhibited by a preponderance of head-to-tail bonding in the oligomerization of these alpha olefins. In the products from Ziegler catalyzed oligomerization not more than twenty percent of the repeating units are linked by head-to-head and tail-to-tail bonding. In the present invention it has been found that at least forty percent of the repeating units are bonded by head-to-head or tail-to-tail connections. The $C_3$–$C_5$ alpha-olefin oligomers of the present invention contain not more than 60% regio-regularity, where 100% regio-regularity corresponds with all head-to-tail connections for the recurring oligomeric unit.

In Table 1 the results of the spectroscopic determination of the regio-regularity of the products of the present invention are presented (nos. 3–5) as well as the results from the products of 1-decene and 1-hexene oligomerization. The C-13 NMR spectra and the INEPT (Insensitive Nuclei Enhancement by Polarization Transfer) spectra of four products prepared from Cr/SiO2 catalyzed HVI-PAO oligomerization process reactions of 1-decene, 1-hexene, 1-butene and propene are presented. For each oligomer, the chemical shifts of the methylene and methine carbons of the backbone are calculated and assigned based on different combinations of regio-irregularity. From the 2/4J INEPT spectrum which selectively detects only the methine carbons, the amount of regio-regularity of each oligomer is estimated. Entries 1–4 compare four different alpha-olefins as the starting material. The results indicate that the oligomers from the higher olefins are formed in a more regio-regular fashion than the lower olefins.

TABLE 1

| No. | Starting Olefin | Viscosity @ 100° C., cS | % Regio-Regularity |
|---|---|---|---|
| 1 | 1-decene | 145.0 | >58 |
| 2 | 1-hexene | 92.8 | ~51 |
| 3 | 1-butene | 103.7 | ~48 |
| 4 | propene | 95.3 | ~41 |
| 5 | 1-butene | 2.8 | ~38 |

EXAMPLE 1

Catalyst Preparation and Activation Procedure 1.9 grams of chromium (II) acetate ($Cr_2(OCOCH_3)_4 2H_2O$) (5.58 mmole) (commercially obtained) is dissolved in 50 cc of hot acetic acid. Then 50 grams of a silica gel of 8–12 mesh size, a surface area of 300 $m^2/g$, and a pore volume of 1 cc/g, also is added. Most of the solution is absorbed by the silica gel. The final mixture is mixed for half an hour on a rotavap at room temperature and dried in an open-dish at room temperature. First, the dry solid (20 g) is purged with $N_2$ at 250° C. in a tube furnace. The furnace temperature is then raised to 400° C. for 2 hours. The temperature is then set at 600° C. with dry air purging for 16 hours. At this time the catalyst is cooled down under $N_2$ to a temperature of 300° C. Then a stream of pure CO (99.99% from Matheson) is introduced for one hour. Finally, the catalyst is cooled down to room temperature under $N_2$ and ready for use.

EXAMPLE 2

A $Cr/SiO_2$ catalyst was prepared as described in Examples 1.

3 gram of the activated $Cr/SiO_2$ catalyst was packed in a fixed bed down flow reactor of ⅜" id. Propylene of 5 gram per hour was reacted over the catalyst bed heated to 180–190 C. and at 220 psig. After 16 hours, 56.2 gram of liquid product and 24.9 gram of gas were collected. The gas product analyzed by gc contained 95% propylene. The liquid product had the following compositions:

| | $C_6$ | $C_9$ | $C_{12}$ | $C_{15}$ | $C_{18}$ | $C_{21}$ | $C_{24}$ | $C_{27}$ | $C_{30}$ + |
|---|---|---|---|---|---|---|---|---|---|
| wt % | 10.6 | 11.2 | 8.6 | 7.4 | 3.3 | 3.9 | 2.9 | 3.9 | 48.3 |

The product from $C_6$ to $C_{12}$ can be used as gasoline components. The products from $C_{12}$ to $C_{24}$ can be used as distillate components. The unhydrogenated lube product, most $C_{27}$ and higher hydrocarbons and isolated after distillation at 180 C/0.1 mm Hg, have viscosity at 100 C of 28.53 cS and VI of 78. The unhydrogenated lube product had higher VI than the same viscosity oil produced from propylene, by $AlCl_3$ or $BF_3$ catalyst, as summarized below.

| Catalyst | Unhydrogenated lube yield | V @ 100 C., cS | VI |
|---|---|---|---|
| $AlCl_3/HCl$ | 87 | 29.96 | 38 |
| $BF_3H_2O$ | 23 | 7.07 | 46 |

The unhydrodenated lube product from $Cr/SiO_2$ catalyst has similar C13-NMR spectrum than lube by acid catalyst.

EXAMPLE 3

The procedure of Example 2 was followed, except that the reaction was run at 170 C and 300–400 psig. After 14 hours reaction, 47.5 grams liquid and 18.4 g gas (mostly propylene) were collected. The liquid product had the following composition, analyzed by gc:

| $C_6$ | $C_9$ | $C_{12}$ | $C_{15}$ to $C_{20}$ | $C_{20}$ to $C_{30}$ | $C_{30}$ + |
|---|---|---|---|---|---|
| 4.51 | 5.53 | 5.01 | 12.22 | 5.30 | 67.43 |

The unhydrogenated lube fraction after distillation to remove light end at 160° C./0.1 mm Hg, had viscosity at 100 C of 39.85 cS and VI of 81.

EXAMPLE 4

A $Cr/SiO_2$ catalyst was prepared as in Example 1.

To a tubular reactor packed with three grams of 1% Cr on silica catalyst, propylene of 5 g/hr and ethylene 1.13 g/hr (Molar ratio of $C_3/C_2=3$) were fed through at 190 C and 200–300 psig. The liquid product weighed 68 grams, after 15 hours on stream. This once-through liquid yield was 75%. The gas contained ethylene and propylene which can be recycled. The liquid product was centrifuged to remove the small amount of solid particles. The clear liquid was fractionated to give 50% light fraction boiling below 145 C at 0.01 mmHg and 50% unhydrogenated lube product. The unhydrogenated lube product had V@100 (viscosity at 100 C)=46.03 cS, V@40 (viscosity at 40 C)=703.25 cS and VI=112. The light fractions are unsaturated olefinic hydrocarbons with six to 25 carbons. The ir showed the presence of internal and vinylidene double bonds. These olefins can be used as starting material for synthesis of other value-added products, such as detergents, additives for lube or fuel. These light fractions can also be used as gasoline or distillates.

This example demonstrates that one can produce lube with high VI from ethylene and propylene mixture over an activated Cr on silica catalyst. The light product can be useful as chemicals or fuel.

EXAMPLE 5

The run in Example 2 was continued for another 23 hours and 78 grams liquid product was collected. The once-through liquid yield was 54%. This liquid product was centrifuged to remove the solid precipitate. The clear product was fractionated to give 35% light liquid boiling below 145 C at 0.1 mmHg and 65% viscous unhydrogenated lube product. The unhydrogenated lube product had V@100=72.40 cS, V@40=980.73 cS and VI=144.

EXAMPLE 6

The reactor, propylene and ethylene feed rates were the same as in Example 4. In addition, n-octane was fed through the reactor at 10 cc/hr as solvent at 185 C. After 17 hours on stream, 228 grams of liquid product was collected. Material balance indicated that all ethylene and propylene was converted into liquid product. The liquid, after filtering off trace solid, was fractionated to give four fractions:

Fraction 1, boiling below 130 C, 118 g, mostly n-octane solvent;

Fraction 2, up to 123 C/0.01 mmHg, 32 g.;

Fraction 3, up to 170 C/0.01 mmHg, 27 g; and

Fraction 4, residual product, 40 g.

Fraction 4 has the following viscometric properties: V@100=30.99 cS, V@40=343.44 cS, VI=126.

This Example demonstrates that the presence of an inert solvent is advantageous to produce lower viscosity lube. The presence of an inert solvent also prevents the reactor from plugging by trace solid formation.

Although the present invention has been described with preferred embodiments, it is to be understood that modifications and variations may be resorted to, without departing from the spirit and scope of this invention, as those skilled in the art will readily understand. Such modifications and variations are considered to be within the purview and scope of the appended claims.

What is claimed is:

1. A process for the preparation of liquid hydrocarbons suitable as lubricant basestocks from a mixture of $C_2$–$C_5$ alpha-olefins, comprising:

contacting said mixture under oligomerization conditions, at reaction temperature of about 0° C. to 250° C. and at a pressure from 0.1 Atm to about 5,000 psig with a chromium catalyst on a porous support, which catalyst has been treated by oxidation at a temperature of 200° C. to 900° C. ion the presence of an oxidizing gas and then by treatment with a reducing agent at a temperature and for a time sufficient to reduce the chromium of said catalyst to a lower valence state, whereby liquid olefin oligomers are produced.

2. The process of claim 1 containing the further step of hydrogenating said liquid olefin oligomers, or a fraction thereof, under conditions sufficient to convert said olefin oligomers or said fraction into saturated hydrocarbons.

3. The process of claim 1 wherein said mixture of alpha-olefins consists essentially of propylene and ethylene present in a molar ratio of propylene to ethylene between 10 to 1.

4. The process of claim 1 wherein said mixture of alpha-olefins consists essentially of propylene and ethylene present in a molar ratio of propylene to ethylene about 3.

5. The process of claim 1 wherein said reaction temperature is preferably between 90–250 C.

6. The process of claim 1 wherein said lubricant basestock has a viscosity between 3 cS and 5000 cS, measured at 100 C.

7. The process of claim 1 wherein said liquid hydrocarbons contain a light olefinic hydrocarbon fraction containing between about 6 and 25 carbon atoms useful as gasoline and distillate fuels.

8. The process according to claim 1 wherein said oligomerization conditions further comprise addition of inert solvent whereby low viscosity lubricant basestock is produced having a high viscosity index.

9. The process according to claim 8 wherein said inert solvent comprises $C_6$–$C_{12}$ saturated hydrocarbons.

10. The process of claim 9 wherein said hydrocarbons comprise n-octane.

11. The process of claim 1 wherein said reducing agent comprises carbon monoxide, oligomerization temperature is about 100–200 C, pressure is between 10 and 400 psig, and the yield of lube product having a viscosity at 100 C greater than 35cS is greater than 35%.

12. The process of claim 1 wherein said porous support comprises silica.

13. The process of claim 11 wherein the mixture is contacted in a fixed bed reactor.

14. The process of claim 11 wherein the mixture is contacted in a continuous stir tank reactor.

15. A process for the preparation of liquid hydrocarbons, said process comprising the steps of:

(a) contacting $C_3$–$C_5$ alpha-olfeins with a chromium catalyst on a support, at a temperature from 90° to 250° C., which catalyst has been treated by oxidation at a temperature of 200° C. to 900° C. in a presence of an oxidizing gas and then by treatment with carbon monoxide as a reducing agent at a temperature and a time sufficient to reduce the chromium of said catalyst, said contacting taking place under conditions sufficient to produce liquid olefin oligomers, (b) distilling said oligomers of step (a) under conditions sufficient to recover a gasoline boiling range overhead fraction, a distillate boiling range overhead fraction and a lube boiling range bottoms fraction.

16. The process of claim 15 comprising the further step of hydrogenating said liquid olefin oligomers.

17. The process of claim 15 comprising the further step of adding inert solvent whereby said alpha-olefins and said chromium catalyst are contacted in a slurry.

18. The process according to claim 17 where said inert solvent comprises $C_6$–$C_{12}$ saturated hydrocarbons.

19. The process of claim 15 wherein said contacting conditions comprise temperature between 90–250 C, pressure between 10–400 psi, wherein said lube product has a viscosity greater than 3 cS and viscosity index greater than 70, measured at 100 C.

20. The process of claim 15 wherein said liquid oligomers contain at least 40 wt. percent $C_{30}$+ lubricant range oligomers.

21. The process of claim 16 wherein said conditions comprise temperature of about 135 C at a pressure of 60 psig and said bottoms fraction has a viscosity at 100 C of at least 90 cS and viscosity index of at least 80.

22. The process of claim 15 wherein said alpha-olefin and said catalyst are contacted in a fixed bed reactor.

23. The process of claim 15 wherein said alpha-olefin and said catalyst are contacted in a stirred tank reactor.

24. The process of claim 15 wherein said alpha-olefin comprises propene.

25. The process of claim 15 wherein said alpha-olefin comprises 1-butene.

26. A liquid lubricant composition comprising the product of the oligomerization of $C_3$ to $C_5$ alpha-olefin feedstock, or mixtures thereof, under oligomerization conditions in contact with a reduced valence state Group VIB metal catalyst on porous support, said lubricant having a regio-regularity not greater than 40%.

27. The composition of claim 26 wherein said oligomerization conditions comprise temperature between 90°–250° C. said catalyst comprises CO reduced $CrO_3$ and said support comprises silica having a pore size of at least 40 Angstroms.

28. A liquid lubricant hydrocarbon composition comprising the polymeric residue of alpha-olefins taken from the group consisting essentially of $C_3$ -$C_5$ alpha-olefins, said composition having a regio-regularity not greater than 40%.

29. The composition of claim 6 or 8 wherein said alpha-olefin comprises propene.

30. The composition of claim 6 or 8 wherein said alpha-olefin comprises 1-butene.

* * * * *